United States Patent [19]

Vorrasi

[11] 4,039,819

[45] Aug. 2, 1977

[54] COMBINED WRITING INSTRUMENT AND SLIDE RULE

[76] Inventor: Michael Vorrasi, Box 7080, Hollywood, Fla. 33021

[21] Appl. No.: 626,830

[22] Filed: Oct. 29, 1975

[51] Int. Cl.[2] ..... B43K 29/10

[52] U.S. Cl. ..... 240/6.46; 235/70 D; 240/2 E

[58] Field of Search ..... 235/64, 70 D; 240/2 E, 240/6.4 R, 10.65 D, 6.46

[56] References Cited

U.S. PATENT DOCUMENTS

| | | | |
|---|---|---|---|
| 1,443,106 | 1/1923 | Walsh | 240/10.6 SD |
| 2,038,514 | 4/1936 | Hummert | 240/10.6 SD |
| 2,407,106 | 12/1946 | Shelly | 235/70 D |
| 2,412,820 | 12/1946 | Magee | 235/70 D |
| 3,150,559 | 9/1964 | Baasner et al. | 240/46.43 |

FOREIGN PATENT DOCUMENTS

| | | | |
|---|---|---|---|
| 2,857 | 2/1915 | United Kingdom | 235/70 D |

*Primary Examiner*—Lawrence R. Franklin

[57] ABSTRACT

An elongated transluscent plastic cylindrical member has a mechanical pencil formed at one end and has a longitudinally directed ridge projecting radially from the member on which are located first slide rule scales. A longitudinally slotted transluscent plastic tubular member slideably receives the cylindrical member with the ridge within the slot. The tubular member carries second slide rule scales along the slot for cooperation with the first scales. The cylindrical member carries a lamp and batteries for illuminating the scales.

1 Claim, 4 Drawing Figures

COMBINED WRITING INSTRUMENT AND SLIDE RULE

FIELD OF THE INVENTION

The present invention relates generally to a combined writing and computing instrument having telescoping elements carrying cooperating scales. In its particular aspects the present invention relates to the provision of a lamp within the instrument configured for illuminating the scales.

BACKGROUND OF THE INVENTION

The prior art is already aware of combined writing and computing instruments such as U.S. Pat. No. 3,568,923 to Chapman and combined writing instruments and extensible rulers such as U.S. Pat. No. 1,607,097 to Murphy. One problem with prior art devices of these two types is that they have been relatively expensive to produce. Another problem associated with such devices is that it has not been possible to view the scales carried by the devices in dim light.

OBJECTS OF THE INVENTION

It is an object of the present invention to provide a combined writing and computing instrument of the type having relatively slideable cooperating scales which includes means for illuminating the scales.

It is another object of the present invention to provide a combined writing, computing and lighting instrument of simple and inexpensive construction.

SUMMARY OF THE INVENTION

Briefly, the aforementioned and other objects of the present invention are satisfied by providing an elongated generally cylindrical member having an elongated longitudinally directed ridge projecting transversely of the member. The ridge is defined between a pair of parallel straight edges along which are formed first numerical scales. The cylindrical member is slideably received in a longitudinally slotted tubular member with the ridge projecting through the slot. Second numerical scales formed on the slotted member along opposite sides of the slot therein, cooperate with the first scales in the nature of a slide rule.

A writing element such as a mechanical pencil is formed at one end of the cylindrical member while a lamp and batteries are carried within the cylindrical member at an end remote from the writing element.

The cylindrical and tubular members are each formed of a transluscent plastic material for enabling the scales to be edge lit. Another feature of the present invention is the provision of a variable iris in the form of a pair of relatively rotatable vaned members for adjusting the output illumination of the lamp when the device of the present invention is utilized as a flashlight.

Still another feature of the prsent invention is the mounting of a switch for operating the lamp on the aforementioned ridge.

Other objects, features and advantages of the present invention will become apparent upon perusal of the following detailed description of the preferred embodiment thereof when taken in conjunction with the appended drawing wherein.

DETAILED DESCRIPTION

Figure 1:
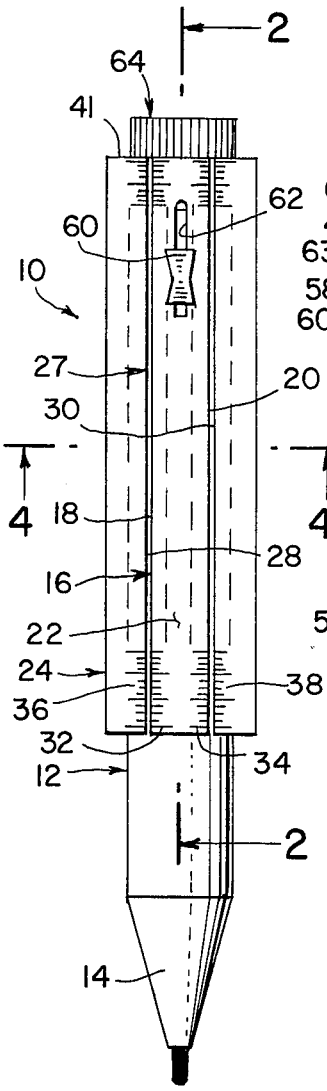
FIG. 1 is a front view of the combined writing and computing instrument of the present invention.
Figure 2:
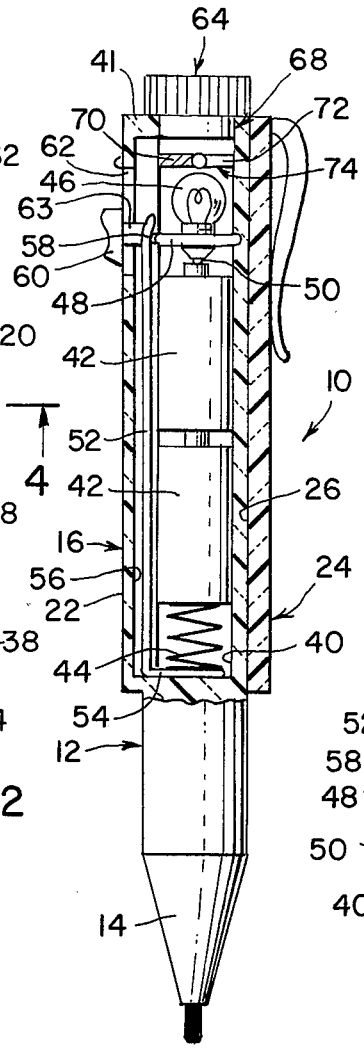
FIG. 2 is a partial cross-sectional view taken through the lines 2—2 in FIG. 1.
Figure 3:
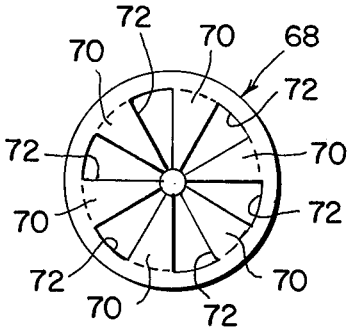
FIG. 3 is a view from the top of FIG. 1.
Figure 4:
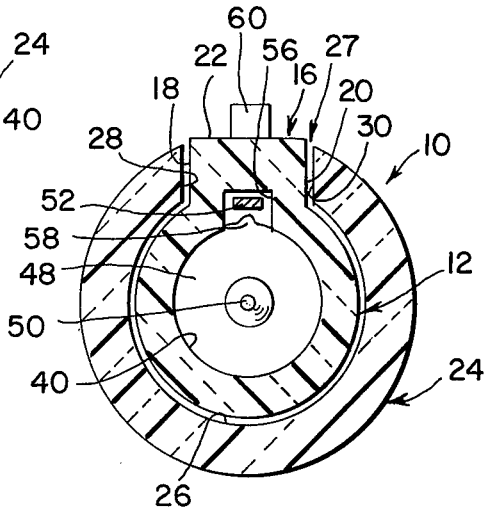
FIG. 4 is a cross-sectional view taken through the lines 4—4 in FIG. 1.

Referring to FIGS. 1 through 4 of the drawing, the combined writing and computing instrument of the present invention is generally indicated by the reference numeral 10. Instrument 10 includes an elongated generally cylindrical member 12 which has a writing element 14 such as mechanical pencil tip formed at one end of the member. Member 12 further has a longitudinally elongated integral ridge 16 projecting radially or transversely of the member. Ridge 16 is generally of rectangular cross-section and includes a pair of longitudinally directed opposed parallel planar edges 18 and 20 and a planar crest surface 22 between the edges.

An elongated generally tubular member 24 slideably receives member 12 within a circular bore 26 of member 24. Member 24 has a longitudinally elongated slot 27 through its wall defined between a pair of opposed planar parallel edges 28 and 30. As should be apparent from the drawing, the ridge 16 projects through the slot 27 with the edges 18 and 20 of the ridge respectively adjacent the edges 28 and 30 of the slot. The ridge 16 and slot 27 cooperate to prevent rotation of member 12 in member 24 and further serve as a guide for relative sliding between the members.

Along edges 18 and 20 there are respectively formed first numerical logarithmic scales 32 and 34 which cooperate with second numerical logarithmic scales 36 and 38 respectively formed along edges 28 and 30. It should be apparent that the scales 32 and 34 can be shifted in relation to the scales 36 and 38 for computation in the nature of a slide rule.

The cylindrical member 12 has a coaxial cylindrical cavity or bore 40 therein running generally from the end 41 of the member remote from writing element 14 to just above the element 14. Within the cavity 40 there is located a column of battery cells 42 which rests on a metal spring 44 urging the cells 42 toward end 41. An incandescent lamp 46 threadably mounted through a metal disc 48 is secured coaxially in cavity 40 near end 41. The column of batteries 42 is urged by spring 44 to contact the central terminal 50 of lamp 46. Disc 48 forms the other terminal of the lamp 46.

An elongated metal strip 52 which has one end 54 contacting spring 44 runs longitudinally within member 12 in a longitudinally directed channel recess 56 communicating with cavity 40. The channel 56 is preferably formed in the thickened wall of ridge 16. Strip 52 terminates alongside a radially projecting dimple 58 in disc 48 and is switchably forced in contact therewith by an actuating slider 60 mounted through a longitudinally directed slot 62 in ridge 16. The slider 60 includes a radially inwardly projecting wedge member 63 for bending strip 52 into contact with dimple 58 to energize lamp 46 when the slider is positioned at a lower extremity of slot 62. The upper extremity of the slot 62 corresponds to an off position.

Both the members 12 and 24 are preferably made of transluscent plastic material capable of total internal reflection to enable a large portion of the light output of lamp 46 to emanate from edges 18, 20, 28 and 30 to illuminate scales 32–38.

As a further feature, the instrument 10 may be used as a flashlight having an output light emanating from end 41. In order to selectively direct light from lamp 46 either out end 41 or for edge lighting the scales 32–38, and for regulating the proportions of the light output directed to these two areas, a variable iris means 64 is formed at end 41 which includes a rotatably mounted reflective disc 68 having angularly spaced sectorial vanes 70 alternating with openings 72. The disc 68 cooperates with a similar disc 74 fixedly mounted in cavity 40 between lamp 46 and end 41. As should be apparent, the disc 68 is rotated for varying the overlapped open area defined between the vanes 70 of the two discs 68 and 74.

While the preferred embodiment of the present invention has been described in specific detail, it should be understood that numerous modifications, additions and omissions in the details thereof are possible within the intended spirit and scope of the invention claimed herein.

What is claimed is:

1. A combined writing and illuminated computing instrument adapted to receive a battery means; said instrument comprising a first elongated translucent generally tubular member; a writing means carried at one end of said first member; an elongated ridge projecting radially of said first member and being directed along substantially the entire length of said first member; first numerical scale means formed on said ridge; a generally tubular second translucent member having a longitudinally directed elongated slot and having second numerical scale means formed along said slot; said seond member being slideably received about said first member with said slot slideably receiving said ridge for enabling relative longitudinal manipulation of said first and second scales; the interior of said first tubular member comprising an elongated cavity for receiving said battery means, a lamp means mounted in said cavity proximate the other end of said first member for illuminating said first and second scales and for enabling some of the light from said lamp means to be directed out said other end; variable iris means carried on said other end of said first member for adjusting the amount of light directed out of said other end; and means carried by said first member for electrically interconnecting said battery means and said lamp means in an electrical circuit; said electrically interconnecting means including a switch means mounted on said ridge.

* * * * *